United States Patent [19]

Mester et al.

[11] B 3,986,033

[45] Oct. 12, 1976

[54] SWITCHING DEVICE FOR AN X-RAY GENERATOR COMPRISING A TIME SWITCH

[75] Inventors: Heinz Mester; Gerd Vogler, both of Hamburg, Germany

[73] Assignee: U.S. Philips Corporation, New York, N.Y.

[22] Filed: Mar. 15, 1974

[21] Appl. No.: 451,534

[44] Published under the second Trial Voluntary Protest Program on January 13, 1976 as document No. B 451,534.

[30] Foreign Application Priority Data

Mar. 22, 1973 Germany ..... 2314267

[52] U.S. Cl. ..... 250/402; 250/413; 250/421

[51] Int. Cl.[2] ..... H05G 1/30

[58] Field of Search ..... 250/421, 413, 415, 416, 250/402

[56] References Cited

UNITED STATES PATENTS 2,668,909 2/1954 Johnston ..... 250/415

*Primary Examiner*—Craig E. Church

*Attorney, Agent, or Firm*—Frank R. Trifari

[57] ABSTRACT

The exposure time in X-ray generators comprising a high-voltage generator which is actuated on the primary side is shorter than the actuation time on the primary side. This is because the high-voltage on the secondary side can follow the voltage on the primary side only at a given delay due to the stray inductance of the transformer. The effective exposure time (i.e. the time during which the X-ray tube emits the desired radiation), consequently, is shorter than the exposure time which is adjusted on the control panel, the reduction also being dependent of the tube current. So as to achieve that the effective exposure time is equal to the exposure time adjusted on the control panel, means are provided which prolong the actuation time in dependence of the exposure current.

12 Claims, 5 Drawing Figures

SWITCHING DEVICE FOR AN X-RAY GENERATOR COMPRISING A TIME SWITCH

Figure 1:
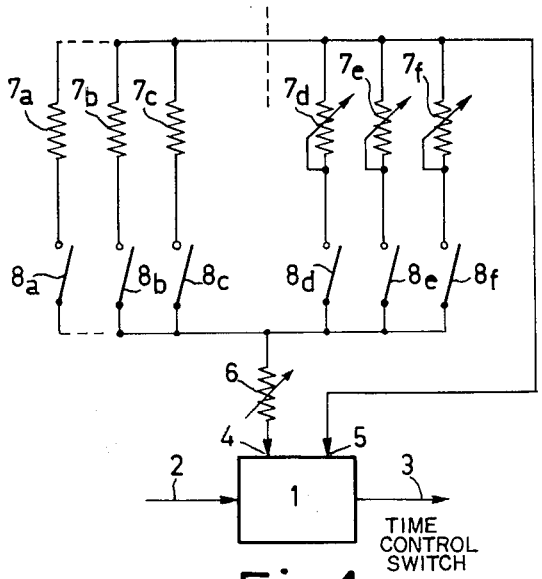

The invention relates to a switching device for an X-ray generator comprising a time switch which is incorporated in the primary circuit of a transformer which supplies the current for an X-ray tube, the actuation time being longer than the exposure time.

A time switch therein serves to interrupt the primary circuit at the end of an exposure time. The actuation time (i.e. the time during which the time switch contact in the primary circuit is closed) must then exceed the exposure time (i.e. the time which is adjusted as the exposure time by the user of the X-ray equipment or during which the X-ray tube emits the desired radiation) only because the electrical voltage across the X-ray tube can follow the voltage across the primary circuit with a given delay due to the unavoidable stray inductances, cable capacitances, etc. Therefore, to correct this problem in known X-ray generators, the actuation time is set to exceed the adjusted exposure time by a fixed amount (for example, 1 ms). This means that when the user adjusts an exposure time of, for example, 1 ms, the actuation time is actually 2 ms, whereas in the case of an adjusted exposure time of 10 ms, the actuation time is really 11 ms.

However, it was found in practice that also in that case the effective exposure time (i.e. the time during which the X-ray tube emits the desired radiation) does not correspond to the exposure time adjusted by the equipment user, particularly in the case of very short exposure times (a few milliseconds). Therefore, an object of the present invention is to design a switching device for an X-ray generator of the kind set forth such that the effective exposure time at least approximates the adjusted exposure time, also especially in the range of very short exposure times.

According to the invention, this object is achieved in that use is made of means by which the time switch actuation time is prolonged beyond the adjusted exposure time in dependence on the current through the X-ray tube.

As already stated, the exposure time is always shorter than the actuation time because the secondary voltage and the secondary current can follow the variation of current and voltage on the primary side only with a given delay. Investigations have revealed that this switch-on delay is larger as the current to be switched is larger. Because this switch-on delay is not compensated for by an equivalent switch-off delay, at least not in X-ray generators whose primary circuit is switched on and off by thyristors, a current-dependent reduction of the exposure time arises, this reduction being larger as the current to be switched is larger. It will be obvious that by using a constant (i.e. fixed) prolongation of the actuation time such as is effected in the known X-ray generators, (e.g. 1 ms), the effective exposure time can be made to correspond to the adjusted exposure time only for one given value of tube current. In the case of smaller tube currents, the effective exposure time becomes too long, while it becomes too short in the case of larger tube currents. By using the technique of current-dependent prolongation of the actuation time according to the invention, it can be achieved that the effective exposure time corresponds to the adjusted exposure time, and independent of the amplitude of the switched X-ray tube current.

In X-ray generators comprising a time switch whose actuation time is determined by a resistor which is active in the time circuit, the actuation time can be prolonged in dependence on the exposure current according to a further preferred embodiment of the invention in that the time circuit incorporates, in addition to a resistor which can be adjusted by means of the adjusting member for the exposure time, a resistor which can be adjusted by means of the adjusting member or the adjusting members for the tube current. In an X-ray generator provided with buttons for selecting fixed current values, an auxiliary resistor which is each time necessary can be switched on, for example, by the corresponding current button.

In X-ray generators with isowatt operation, in which the current varies in dependence on an adjusted power and an adjusted tube voltage, the actuation time is prolonged in dependence on the exposure current according to a further preferred embodiment of the invention in that this auxiliary resistor is adjustable in dependence on the exposure voltage and the power consumption. To this end, the resistor can be adjusted by the adjusting member for the power and also by the adjusting member for the tube voltage.

Investigations have revealed that the correspondence between effective exposure time and adjusted exposure time can be achieved roughly independent of the exposure current if, according to a further embodiment of the invention, the actuation time can be prolonged by a constant (fixed) amount and by an amount which is proportional to the tube current. In this case, the actuation time $T_s = T_a + T_c + T_i\ (I/I_0)$, in which $T_a$ is the adjusted exposure time, $T_c$ is the constant actuation time prolongation, $T_i$ is a time constant, $I$ is the adjusted or measured tube current, and $I_0$ is a fixed current value. The constants $T_c$, $T_i$ and $I_0$ can be proportioned such that the effective exposure time each time corresponds to the adjusted exposure time, independent of the adjusted tube current. A further embodiment of the invention which is suitable for this purpose is characterized in that it comprises a first timer member (i.e. a nominal timer member) which supplies an output pulse at the end of the adjusted exposure timer, and a second timer member (i.e. a correction-time member) which supplies an output pulse at the end of a period of time which is proportional to the tube current, one of the aforesaid timer members being controlled by the output pulse of the other timer member. In order to obtain the constant (fixed) actuation time prolongation $T_c$, a separate timer member can be incorporated, but alternatively one of the two timer members can be constructed such that the output pulse thereof is delayed by this constant amount.

A further embodiment according to the invention is characterized in that the timer member comprises a generator which generates an increasing signal after having been started, an output pulse being generated when this increasing signal reaches the value of a signal proportional to the tube current.

In a correction timer member of such a construction the actuation time can be prolonged by a constant amount according to a further preferred embodiment of the invention in that a direct voltage is superimposed on the increasing signal.

In principle, the sequence of operation or connection of the nominal timer and the correction timer can be chosen at random, i.e. the correction timer member can be started by the output pulse of the nominal timer member and vice versa. However, if the correction timer member is started first (by the switch-on pulse), it may occur that the value of the increasing signal reaches the value of the signal proportional to the tube current before the tube current has reached its stable final value. The resultant error can be corrected in a further embodiment according to the invention in that the increasing signal is derived from a capacitor which can be charged via a constant resistance and a direct voltage source which can be switched on. The variation of the voltage across this capacitor is not entirely linear so that the said error can be corrected by suitable proportioning.

An advantage of a switching device comprising a correction timer member which precedes the nominal timer member is that the exposure time can be measured also in operation with an automatic exposure device. Accordingly, in a further preferred embodiment according to the invention, the output pulse of the correction timer member starts a time indicator which is stopped by the output pulse of the nominal timer member or by the switch-off pulse of the automatic exposure device.

Figure 2:
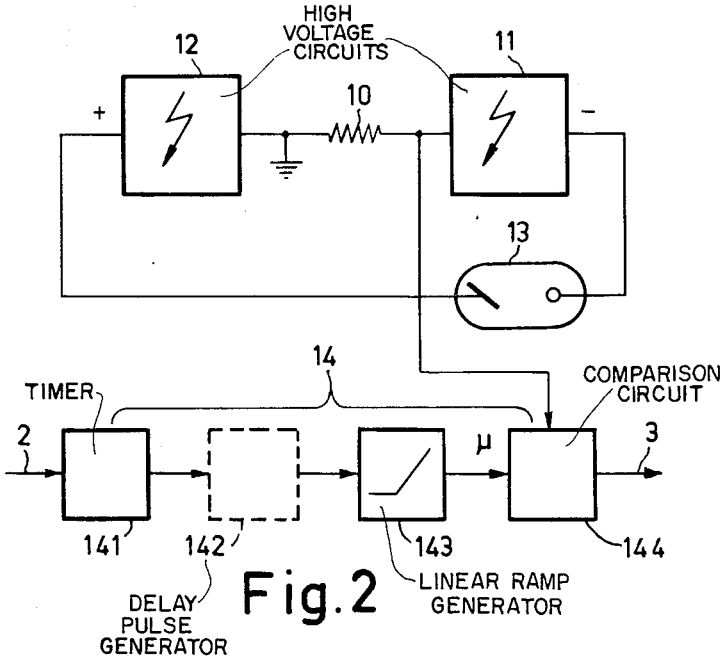
Figure 3:
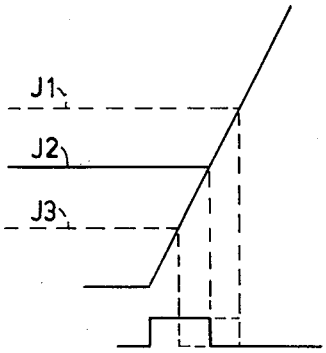
Figure 4:
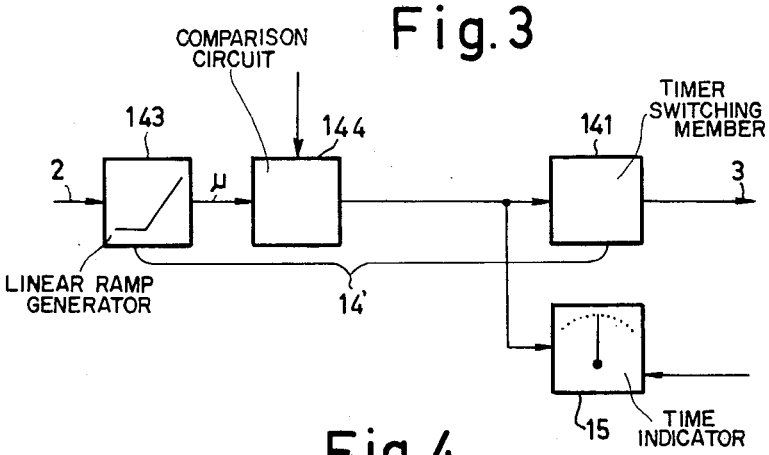
Figure 5:
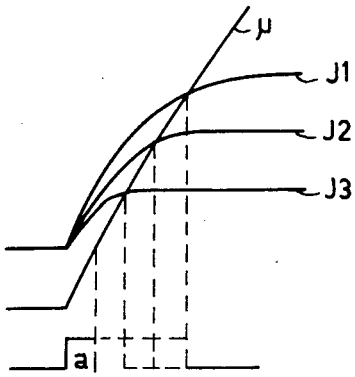

Some preferred embodiments according to the invention will be described in detail hereinafter with reference to the drawing, in which FIG. 1 shows a time circuit of an X-ray generator according to the invention, FIG. 2 shows a high-voltage circuit of an X-ray generator according to the invention, including a timer member which is controlled by the current in the high-voltage circuit, FIG. 3 shows a diagram so as to illustrate the operation of the circuit shown in FIG. 2, FIG. 4 shows a further preferred embodiment according to the invention, and FIG. 5 shows a diagram so as to illustrate the operation of the circuit shown in FIG. 4.

The timer circuit which is diagrammatically shown in FIG. 1 forms part of a conventional time switch, the other components of which (switching circuit for switching off the primary voltage etc.) can be of a conventional construction and which, therefore, are not shown in the drawing, nor is the X-ray generator itself shown. The timer circuit comprises a time control switch 1 which is started by a switch-on pulse which is supplied via a line 2, the said time control switch supplying a switch-off command via a line 3 at the end of an adjustable actuation time. The time control switch is a conventional circuit and may be similar to the time control circuits described in U.S. Pat. No. 2,668,909. The overall timer circuit includes not only time control switch 1, but also the resistors 6 and 7*a*–7*f* and switches 8*a*–8*f* connected to terminals 4 and 5. The actuation time of the time switch is determined by the resistance active between the terminals 4 and 5. The resistance between the terminals 4 and 5 consists of a series connection of a resistor 6 and one of a series of resistors 7*a* to 7*f* which are connected in series with the resistor 6 by the switches 8*a* to 8*f*, one of which is each time closed. The value of the resistor 6 can be adjusted by way of the adjusting members for the exposure time. The correction of the actuation time in dependence on the exposure current is effected by switching on one of the resistors 7*a* to 7*f*. The switches 8*a* to 8*c* are coupled to an external adjusting member by means of which the user adjusts the X-ray tube current (for example, a keyboard for adjusting the individual current values) so that each time one of the resistors 7*a* to 7*c* which is required for a current overall resistance is connected in series with the resistor 6.

In so-termed isowatt operation, in which the exposure current is generated automatically and independently of the adjusted power and the adjusted voltage, one of the resistors 7*d* to 7*f* is connected in series with the adjustable resistor 6 by way of one of the switches 8*d* to 8*f*. The switch contacts 8*d* to 8*f* are connected to a conventional power selector device which is not shown, the value of the resistors 7*d* to 7*f* being adjusted by means of the adjusting member for the exposure voltage such that as the adjusted tube voltage increases, the value of the resistors 7*d* to 7*f* decreases (because in isowatt operation the tube current automatically also decreases as the voltage increases).

In X-ray generators in which during so-termed dual-control operation the tube current is not directly adjusted but is indirectly determined by adjustment of, for example, the tube voltage and the desired mAs product, the prolongation of the actuation time could in principle also be effected by the addition of a resistor in the time circuit of the time switch. However, because the tube current is dependent on the exposure voltage, the mAs product and the adjusted focal spot, the value of this auxiliary resistor could be changed in dependence on the voltage, the mAs product and the adjusted focussing spot. The variation of a resistor in dependence on the said three exposure parameters, however, is comparatively expensive. Therefore, FIGS. 2 and 4 show an embodiment in which the prolongation of the actuation time is not effected by the adjusting members for the exposure parameters which influence the tube current, but in dependence on the measured tube current.

In accordance with FIG. 2, a measuring resistor 10, grounded on one side, for measuring the tube current, is included in the blocks 11 and 12 which diagrammatically represent the high-voltage circuit of an X-ray tube 13. The voltage drop across the measuring resistor 10 influences a time switching circuit 14 of the time switch. The time switching circuit 14 comprises a timer member 141 a time delay unit (referred to hereinafter as "nominal timer member") which may be similar to control block 1 of FIG. 1. Time member 141 receives a switch-on pulse via the line 2 and supplies a pulse on an output line after the expiration of a period of time (for example, 2 ms) which can be adjusted by the user. This is the adjusted exposure time, Ta. This pulse controls a pulse generator 142, for example, a monostable flip-flop, which generates an output pulse after a constant period of time which is independent of the exposure time, i.e. the constant actuation time prolongation, $T_c$. This constant period is proportioned so that for very small tube currents the effective exposure time corresponds to the adjusted exposure time. The pulse generator 142 can be dispensed with if the actuation time of the nominal timer member 141 is prolonged in advance by this constant amount. The output pulse of the pulse generator 142 is applied to a conventional ramp generator 143 which supplies a linearly increasing output signal $u$ upon the appearance of this pulse signal $u$ is applied to an input of a comparison stage 144. Another input of the comparison stage 144 receives a voltage which is generated by the tube current flowing in the measuring resistor 10. As soon as the voltage $u$ reaches the value of the voltage across the measuring resistor 10, the comparison stage 144, consisting, for example, of a differential amplifier which is followed by a threshold value switch, supplies a switch-off command. The elements 143 and 144 together constitute a second time delay unit (correction time member).

FIG. 3 clearly shows that the increasing voltage $u$ becomes equal to the voltage across the measuring resistor 10 at a time which is determined by the amplitude of the tube current ($I_1$, $I_2$, $I_3$).

In a switching device as shown in FIG. 4, the sequence in which the elements 141 to 144 are arranged differs from that of FIG. 2. The switch-on pulse is applied, via the line 2, to the linear ramp generator 143 which generates an increasing signal which is applied to an input of the comparison stage 144, another input of which receives the voltage across the measuring resistor 10 (see FIG. 2). At the output of the comparison stage 144 a pulse is generated as soon as the increasing voltage $u$ reaches the value of the voltage across the measuring resistor 10 in the high-voltage circuit of the X-ray tube. The shift in time between the input pulse on the line 2 and the output pulse at the output of the comparison circuit 144, therefore, is dependent on the tube current. The output pulse of the comparison stage 144 starts the timer switching member 141 which generates a switch-off pulse at the end of the exposure time adjusted by the user (possibly taking into account the constant actuation time prolongation effected via the line 3).

A drawback of an arrangement of the components of the time switching circuit of this kind with respect to the arrangement shown in FIG. 2 is that in the case of very large tube currents the increasing voltage already reaches the voltage drop generated across the measuring resistor 10 by these tube currents at an instant at which the current has not yet reached its final value. The resultant error can be corrected by a suitable mode of increase of the increasing voltage $u$. An increase curve in accordance with the formula $k\ (1 - e - t/T)$ was found to be advantageous. According to this formula, the voltage changes across a capacitor which is connected to a constant direct voltage via a constant resistor. It was also found to be advantageous (as shown in FIG. 5) to make the increasing voltage start from a lower value than the voltage derived from the tube current. On the one hand, the actuation time is then prolonged by a constant amount $a$ (FIG. 5), and on the other hand this results in a larger spacing between the increasing voltage and the voltage proportional to the tube current, so that the risk of premature pulse generation by interference voltage is reduced.

However, an advantage of the arrangement shown in FIG. 4 is that the effective exposure time can be measured in the case of operation with automatic exposure devices. For this purpose a time indicator 15 is started at the end of the correction time by the same pulse by means of which the nominal timer member 141 is started when use is made of the time switch. The time indication is stopped by the switch-off pulse of the automatic exposure device not shown. The use of an automatic exposure device in this manner is described in our copending U.S. patent application Ser. No. 451,535, filed Mar. 15, 1974. The time indicator displays the effective exposure time in this case. An exposure effected by means of an automatic exposure device can thus be repeated by means of the time switch. This will also produce the same blackening, the other circumstances being the same, if the value measured by time indicator during the first exposure is adjusted on the time selector of the time switch for the subsequent exposure (s).

What is claimed is:

1. In a switching device for an x-ray generator of the type including a high voltage transformer for supplying current to the x-ray tube and a switching element connected in the transformer primary circuit, the improvement comprising a time switch for controlling the actuation time of the switching element wherein the actuation time of the switching element is longer than the exposure time, and means coupled to the time switch for prolonging the switching element actuation time as a function of the x-ray tube current.

2. A switching device as claimed in claim 1 wherein the actuation time of the time switch is determined by a resistor means which is connected in a time circuit of the time switch, said resistor means comprising a first reaistor which can be adjusted by means of an adjusting member for the exposure time and a second resistor which can be adjusted by means of an adjusting member for the x-ray tube current.

3. A switching device as claimed in claim 2, characterized in that the second resistor can be adjusted in dependence on the x-ray tube exposure voltage and on the power consumption.

4. A switching device as claimed in claim 1 further comprising means for prolonging the actuation time by a constant time period.

5. A switching device as claimed in claim 1 wherein the time switch comprises a first time delay unit which supplies an output pulse at the end of the adjusted exposure time, and said actuation time prolonging means comprises a second time delay unit which supplies an output pulse at the end of a period of time which is proportional to the x-ray tube current, one of the time delay units being controlled by the output pulse of the other time delay unit.

6. A switching device as claimed in claim 5, characterized in that the second time delay unit comprises a generator which supplies an increasing signal in response to a start signal, the output pulse being generated when this increasing signal reaches the value of a signal which is proportional to the x-ray tube current.

7. A switching device as claimed in claim 6, further comprising means for superimposing a direct voltage on the increasing signal.

8. A switching device as claimed in claim 6 in which the output pulse of the second time delay unit starts the first time delay unit and the generator produces an increasing signal that increases according to a non-linear curve.

9. A switching device as claimed in claim 5 adapted to operate with an automatic exposure device, in which the output pulse of the second time delay unit starts the first time delay unit, a time indicator, means for applying the output pulse of the second time delay unit to start the time indicator which is stopped by a switch-off pulse generated by the automatic exposure device.

10. A timer for an x-ray generator of the type including a high voltage transformer for supplying current to the x-ray tube and a switching element connected in the transformer primary circuit, said timer comprising, a timing circuit for controlling the actuation time of the switching element, said timing circuit including means for setting the desired exposure time of the x-ray generator, and means coupled to the timing circuit for varying the actuation time of the switching element as a function of the x-ray tube current.

11. A timer as claimed in claim 10 wherein said timing circuit comprises a first timing member for setting the nominal exposure time, a second correction-time member for generating an output signal that is delayed in time as a function of the x-ray tube current, said first and second time members being connected in cascade, and means coupling the correction-time member to the time varying means.

12. A timer as claimed in claim 10 wherein said time varying means comprises means coupled to an adjusting member for the x-ray tube current for varying an electric circuit element of the timing circuit that controls the actuation time of the switching element.

* * * * *